United States Patent [19]

Stangl

[11] Patent Number: 4,581,819

[45] Date of Patent: Apr. 15, 1986

[54] APPARATUS FOR EXCHANGING A BILLET-GUIDING ROLLER FOR ANOTHER IN A PLANT FOR CONTINUOUS CASTING

[76] Inventor: Kurt Stangl, Hauptstrasse 17a, A-4863 Seewalchen, Austria

[21] Appl. No.: 684,003

[22] Filed: Dec. 20, 1984

[30] Foreign Application Priority Data

Dec. 22, 1983 [AT] Austria ..... 4479/83

[51] Int. Cl.[4] ..... B23P 19/00; B22D 11/12; B65G 47/26

[52] U.S. Cl. ..... 29/822; 164/448; 198/339.1

[58] Field of Search ..... 198/339, 486; 164/448; 29/822, 402.08, 426.3

[56] References Cited

U.S. PATENT DOCUMENTS 3,951,323 4/1976 Libossart et al. ..... 164/448
3,954,164 5/1976 Bottomly ..... 198/486
3,994,334 11/1976 Schrewe ..... 164/448

FOREIGN PATENT DOCUMENTS 362541 10/1980 Austria .

*Primary Examiner*—Howard N. Goldberg
*Assistant Examiner*—Steven Nichols
*Attorney, Agent, or Firm*—Karl F. Ross; Herbert Dubno

[57] ABSTRACT

Apparatus for exchanging a billet-guiding roller for another in a plant for continuous casting comprises a handling head, and two pivoted arms, each of which is pivoted to said handling head on an axis that is parallel or identical to the pivotal axis of the other of said pivoted arms. Each of said arms carries a holder for holding a billet-guiding roller. Said handling head also carries arm-driving means for pivotally moving each of said arms about its pivotal axis. In order to minimize the dimensions of said handling head, said pivoted arms have two inner ends, which are adjacent to each other and at which said arms are pivoted to said handling head, and outer ends, which are remote from each other and provided with said holders.

25 Claims, 6 Drawing Figures

APPARATUS FOR EXCHANGING A BILLET-GUIDING ROLLER FOR ANOTHER IN A PLANT FOR CONTINUOUS CASTING

BACKGROUND OF THE INVENTION

1. Field of the Invention

This invention relates to apparatus for exchanging a billet-guiding roller for another in a plant for continuous casting. Said apparatus comprises a handling head, which is adapted to be coupled to a dummy bar and movable with the dummy bar through an array of guide rollers, and which carries two arms, each of which is pivoted on an axis which is parallel to the billet-guiding rollers and is provided with a holder for holding a billet-guiding roller. Said handling head also carries arm-driving means for imparting a pivotal movement to said arms.

2. Description of the Prior Art

In a continuous casting plant it is difficult to remove and install a single billet-guiding roller or guide roller, particularly at the curved portion of the path along which the billet is guided. This difficulty is due to the fact that the guide rollers are relatively closely spaced apart and the arrangement is such that they can be moved to and from their installed position only between the outer and inner curved series of such rollers rather than on the outside of the array formed by said rollers. The exchange of a guide roller is usually effected by means of a handling head, which is provided with a holder for holding a guide roller and which is coupled to the dummy bar, which is otherwise employed to initiate the casting operation. The handling head can then be pulled together with the dummy bar through the array of guide rollers. To permit a removal of a guide roller and a movement of a new guide roller to the position previously occupied by the guide roller which has been removed in such a manner that the handling head is not actuated to remove the old roller from the array of guide rollers until the new roller has been installed in said array, it has been proposed to use an exchanging apparatus (Austrian patent specification No. 362,541) which comprises a handling head, which carries two arms, which are arranged on behind the other and are pivoted on parallel axes and provided with respective holders for holding respective guide rollers, and which also carries arm-driving means for imparting a pivotal movement to said arms. By means of such a handling head the new guide roller can be moved to the desired location and can be exchanged with the old guide roller in a single operation. But as one of the two pivoted arms is pivoted to the end of the handling head and protrudes from the handling head in the longitudinal direction of the array of guide rollers, the exchanging apparatus has a considerable overall length, particularly because additional space is required for the arm-driving means, which consist of actuating cylinders, which are pivoted at one end to the handling head and at the other end to the pivoted arm. Besides, the guide roller holders provided on the pivoted arms must embrace the guide rollers around more than 180° so that the overall height of the handling head cannot be reduced below a certain minimum. For these reasons the known exchanging apparatus has only a restricted field of application and which are closely spaced along along a curved section of the path for the billet because in that region the permissible overall height and overall length of the handling head will be restricted by the spacing of the outer and inner curved series of guide rollers.

SUMMARY OF THE INVENTION

It is an object of the invention to provide for the exchange of a billet-guiding roller for another in a continuous casting plant an apparatus which is of the kind described first hereinbefore and is improved by the provision of a structurally simple handling head, which is small in size so that it can be used for a simple exchange also of closely spaced apart billet-guiding rollers adjacent to the curved section of the path for the billet.

This object is accomplished in accordance with the invention in that the pivoted arms are pivoted at their adjacent ends and provided at those ends which are remote from each other with the holders for holding the guide rollers, and each of said holders comprises a receptacle for receiving a roller and a switch-controlled magnet means for retaining a guide roller in said receptacle.

Because the pivoted arms are pivoted on axes disposed at the adjacent ends of such arms, the space required for the guide rollers received in the holders need not be allowed for in the selection for the locations of the bearings for the pivots for the arms. As a result, the two pivoted arms can be arranged to overlap each other and pivoted arms having a given length can be accommodated in a much smaller space. Besides, the roller holders need not embrace the rollers around more than 180° because a roller receptacle and a switch-controlled retaining magnet are provided. This feature results in a small overall height, which may be substantially as large as the diameter of a roller. It is apparent that a handling head which embodies the features mentioned above may be designed with a smaller length and height than the known handling heads so that even the billet-guiding rollers disposed adjacent to the curved section of the path for the billet can be exchanged in a simple manner.

A particularly simple structure will be obtained if the two arms are pivoted on a common axis. In that case both pivoted arms may be individually pivoted on a pivote which extends throughout the width of the handling head.

To ensure a reliable holding of the guide rollers by the holders carried by the pivoted arms, the retaining magnets must contact the guide rollers. To ensure such contact of the retaining magnets even with deflected guide rollers, the retaining magnets may be mounted on the receptacles by means of magnet carriers, which are pivotally movable between limiting stops. In that case the retaining magnets will by self-adjusting so that the guide rollers will be reliably retained in the holders.

When it is desired to exchange a guide roller of the inner or outer curved series of such guide rollers, the pivoted arms must be actuated to move said guide roller out of the corresponding curved series. If the rollers are closely spaced apart, the roller which is carried by the pivoted arms may engage the adjacent guide roller in the series of guide rollers during the pivotal movement of the pivoted arm. In order to avoid damage in that case, the receptacles for the rollers may be rotatably mounted on the pivoted arms and may be resiliently supported on the pivoted arms so that a roller carried by a pivoted arms can resiliently yield when it engages an adjacent roller.

The resilient support of the receptacles on the pivoted arms can be provided by structurally simple means if each pivoted arm comprises an extension which extends radially with respect to the axis of rotation of the receptacle and is gripped between two rubber springs provided in the receptacles.

To eliminate the need for trailing cables for supplying power, the retaining magnets may consist of electromagnets energized at least one storage battery provided on the handling head.

In order to ensure that the arm-driving means do not increase the space requirement, the arm-driving means may comprise cam slot members, which are non-rotatably connected to respective ones of the pivoted arms, and a slider, which is guided by said cam slot members in cam slots and is adjustable therein in the direction of the pivotal axes of the pivoted arms. In hat case the usual actuating movement in a direction which is transverse to the pivotal axis is replaced by an actuating movement along the pivotal axis so that the space required in the longitudinal direction of the array of guide rollers is greatly decreased. Besides, a larger displacement can be performed so that particularly desirable conditions regarding the action of force will be obtained.

A slider may be associated with each of the cam slot members and the pivoted arms connected to said cam slot member are adjusted in accordance with the configuration of the cam slot as the slider is adjusted along the pivotal axis of the pivoted arm. Because the two pivoted arms are not moved at the same time, however, a common slider may be associated with both cam slot members, which are arranged one behind the other. An adjustment of the slider in one cam slot member will impart a pivotal movement to the pivoted arm that is connected to that cam slot member. When the slider is in an intermediate position in both cam slots, both pivoted arms will be held in position by the slider; this will be desirable for the transportation of the handling head. In such an arrangement the slider must be reliably shifted from one cam slot to the other during the adjustment of the slider.

The two cam slots must be so arranged that they are engageable by the slider throughout their length. To ensure that the slider will engage the cam slots always in the same orientation, each cam slot may be formed in a cylinder or segment of a cylinder which is coaxial to the pivotal axis of the associated arm.

An actuating cylinder might be used to drive the slider. But relatively small forces will be sufficient for the adjustment of the slider by means of a power screw drive and separate means for holding the slider in position will not be required in that case.

Alternatively the pivoted arms can be actuated by arm-driving means comprising for at least one pivoted arm a power screw drive which includes a screw, which is pivoted to the handling head on an axis which is parallel to and spaced from the pivotal axis of the associated pivoted arm, and a nut, which is threaded on said screw and pivotally movable relative to said arm about the pivotal axis of said screw and adapted to be rotated about said screw by means of an electric motor via a worm gear train. In comparison with the conventional actuating cylinders, such power screw drive affords the advantage that the length of the screw need not exceed the required movement for actuating the arm and that the screw may extend transversely to the pivoted arm so that the space requirement will be reduced. The space required by an actuating cylinder is at least twice the required movement because space for the stroke of the piston is also required. For this reason such cylinder cannot extend transversely to the pivoted arms. It is apparent that the proposed power screw drive is superior to the known drive means not only as regards space requirement but also as regards the action of forces.

DETAILED DESCRIPTION OF THE PREFERRED EMBODIMENTS

Figure 1:
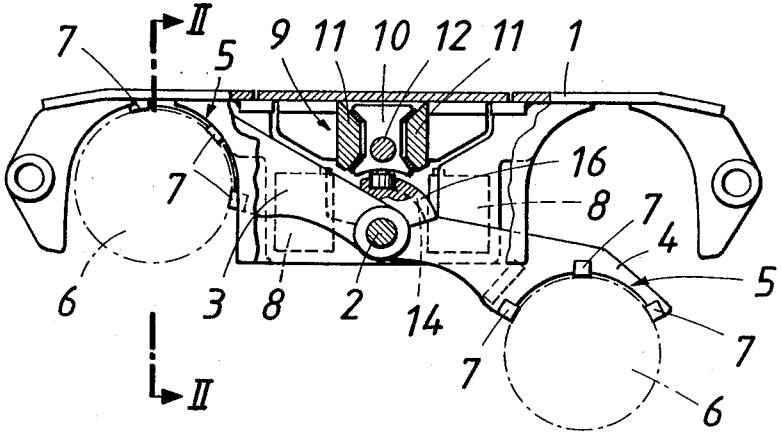
FIG. 1 is a side elevation, partly torn open and shows apparatus in accordance with the invention for exchanging a billet-guiding roller for another in a plant for continuous casting.

Illustrative embodiments of the invention will now be described more in detail with reference to the drawing.

Figure 2:
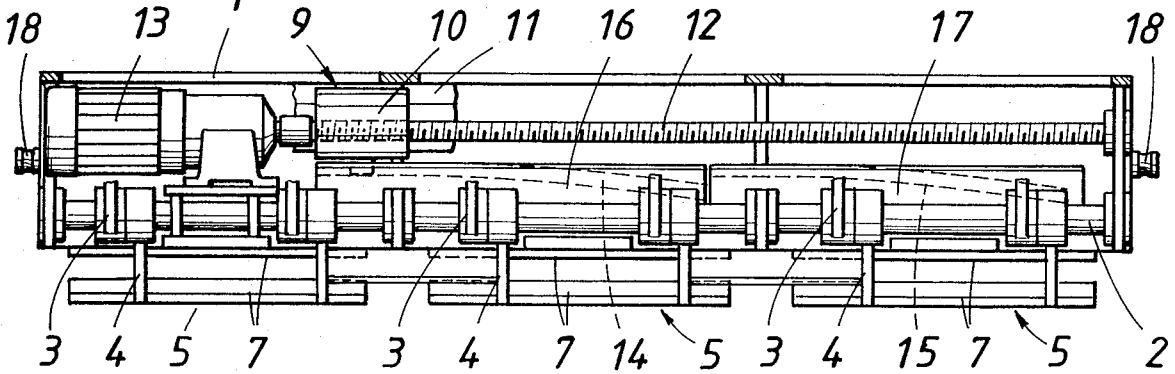
FIG. 2 is a sectional view taken on line II—II in FIG. 1.
Figure 3:
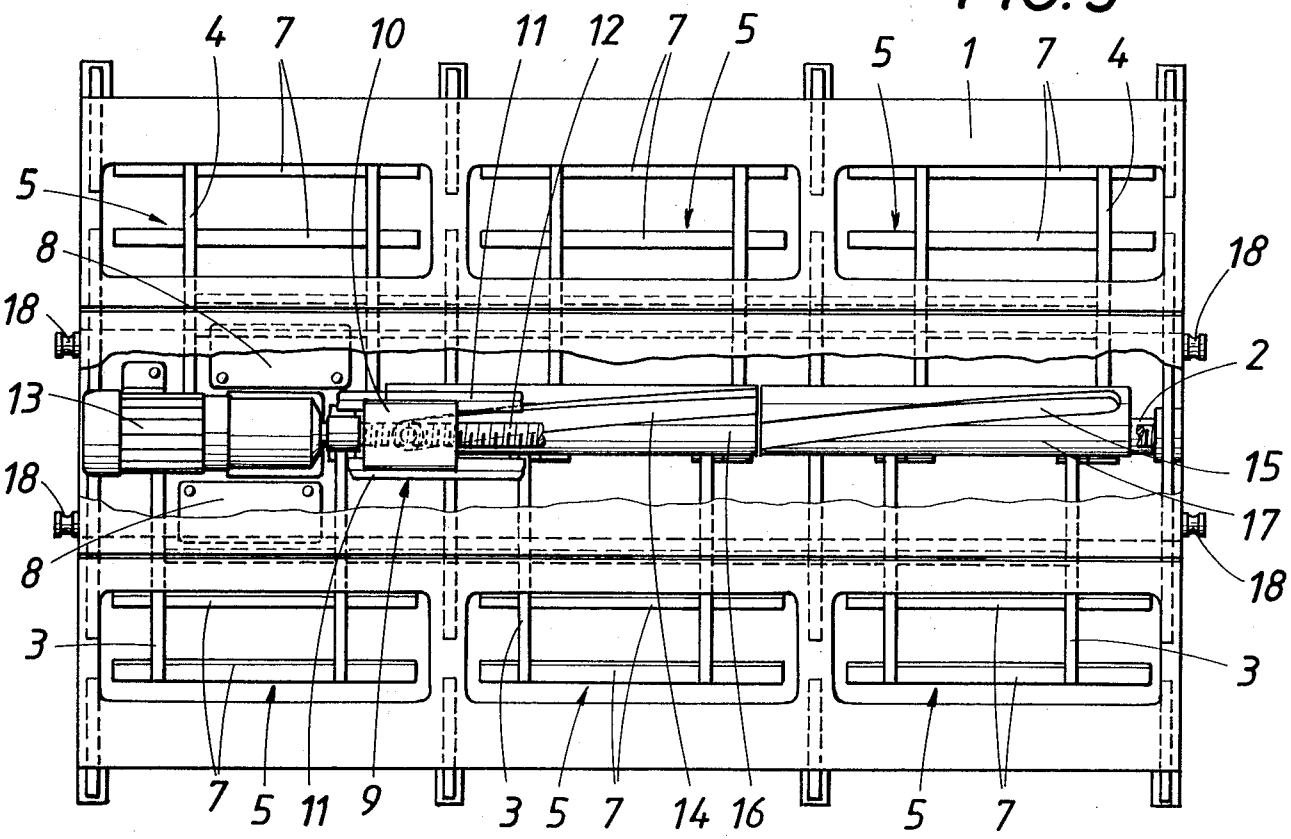
FIG. 3 shows the apparatus in a top plan view, partly torn open.

The apparatus shown in FIGS. 1 to 3 comprises a handling head 1, which is adapted to be coupled to a dummy bar and in which two arms 3 and 4 are pivoted on a common pivot 2. Each of the pivoted arms 3 and 4 comprises a plurality of cheeks. At their outer ends, which are remote from each other, the arms 3 and 4 are provided with respective holders 5, each of which is adapted to hold a billet-guiding roller or guide roller 6. Each holder 5 is provided with magnets 7 for retaining the guide roller 6 when it has been received by the holder 5. Each retaining magnet 7 consists of an electromagnet, which is energized by a storage battery 8 mounted on the handling head 1 so that trailing cables are not required.

Arm-driving means 9 for imparting pivotal movements to the two pivoted arms 3 and 4 comprise a slider 10, which is slidable in a track 11 that consists of two rails and is parallel to the pivot 2 for the pivoted arms. That slider is actuated by means of a gearmotor 13 via a power screw 12. The slider 10 cooperates with two cam slots 14 and 15, which are formed in respective cylinder segments 16 and 17, which are coaxial to the pivot 2 and arranged one behind the other in the direction of the pivot 2 and non-rotatably connected to the pivoted arms 3 and 4. If the slider 10 is moved by the power screw 12 along the track 11 from the end position shown in FIGS. 2 and 3, the cylinder segment 16 formed with the cam slot 14 will be rotated about the pivot 2 in dependence on the configuration of the cam slot so that the pivoted arm 4 which is operatively connected to the cylinder segment 16 will be moved from its extended position shown in the drawing to the position in which said arm is retracted in the handling head. When the slider 10 extends in both cam slots 14 and 15, which are open toward each other, when bot arms 3, 4 are retracted to the handling head 1, the two pivoted arms 3 and 4 will be locked in position. When the slider 10 is subsequently displaced toward the other end of the track 11, the cooperation of the slider 10 with the cam slot 15 will result in a pivotal movement of the cylinder segment 17 and in an outward pivotal movement of the pivoted arm 3 connected to said cylinder segment 17.

By the movements which can be imparted to the pivoted arms 3 and 4 by these drive means, one of the guide rollers 6 of a plant for continuous casting can be held by the holder 5 of one pivoted arm 3 or 4 and can be replaced by a new guide roller 6 supplied by the other of said pivoted arms in an operation in which the handling head 1 and the dummy bar connected thereto need not be moved out of the array of guide rollors in order to carry off the guide roller which has been removed and to supply the new guide roller. To permit the use of a single handling head 1 for a replacement of each guide roller of the outer and inner curved series of guide rollers, the handling head 1 can be coupled to the dummy bar in two positions, which are spaced apart by an angle of 180° around the pivot 2 for the pivoted arms 3, 4. To permit the handling head 1 to be inverted, the handling head 1 is provided on each side with a pair of trunnions 18, which are eccentric with respect to the pivot 2. By means of said trunnions 18 the handling 2 can be suspended with an initial torque which is due to the weight of said head.

Figure 4:
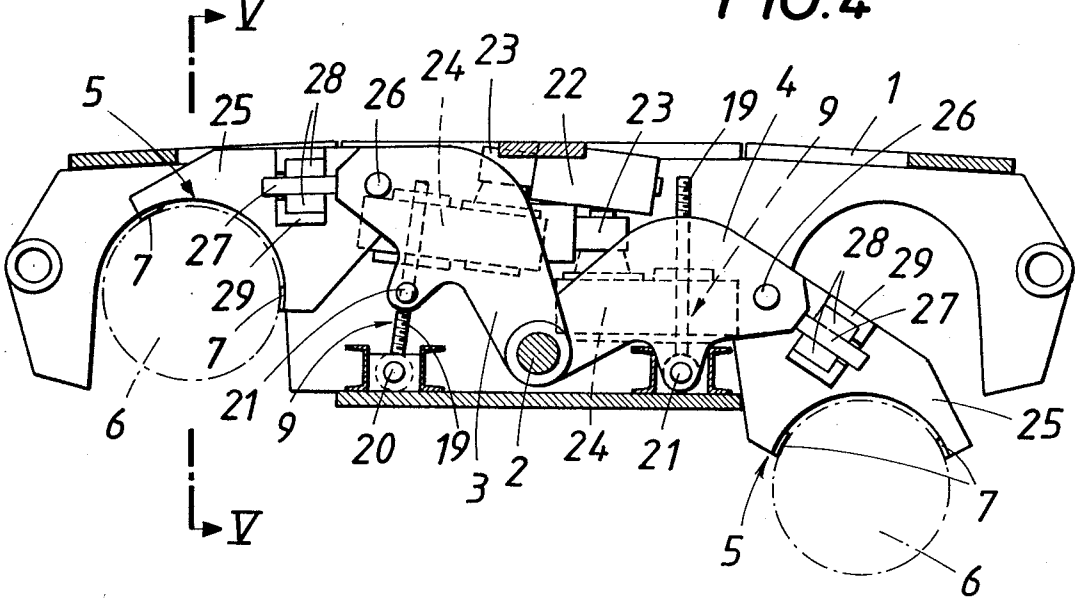
FIG. 4 is an enlarged view which is similar to FIG. 1 and shows a modified structure.
Figure 5:
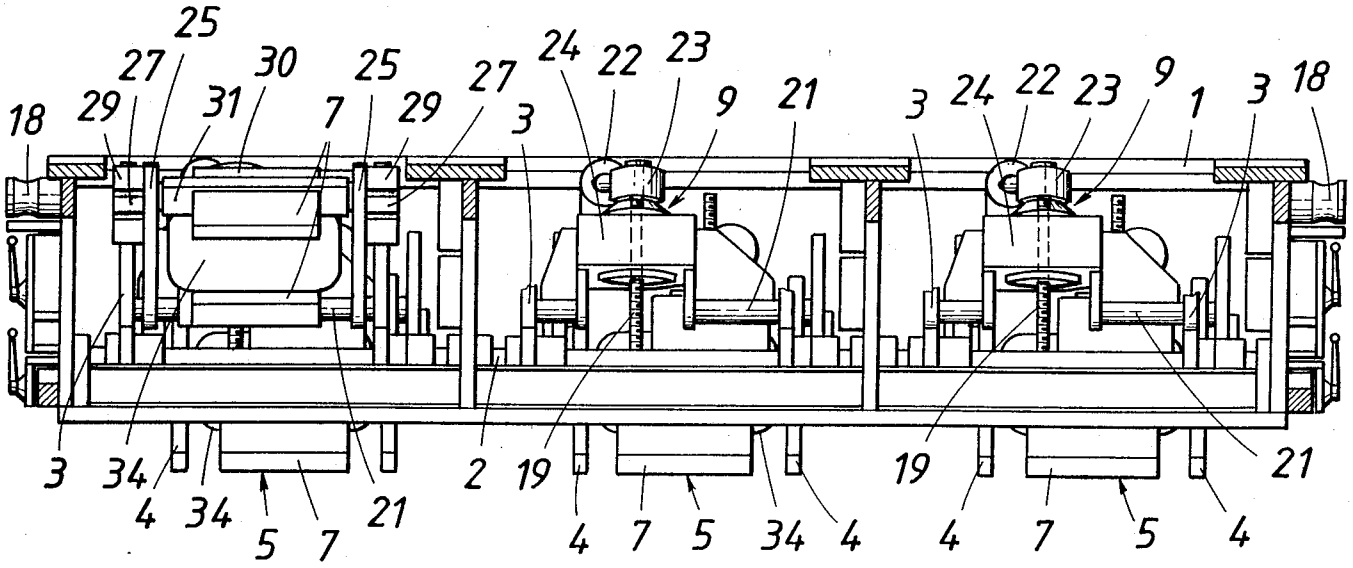
FIG. 5. is a sectional view taken on line V—V of FIG. 4.
Figure 6:
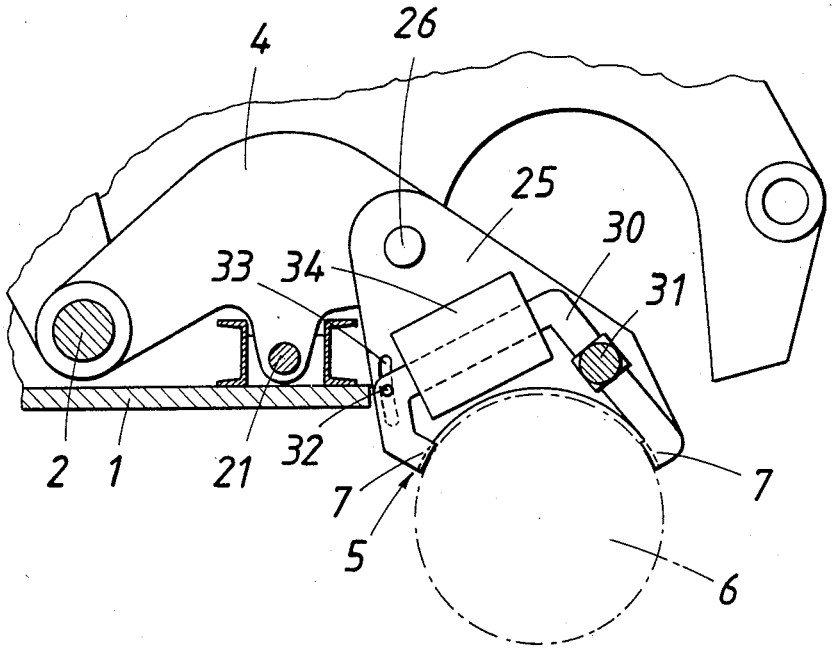
FIG. 6 is a side elevation showing on a larger scale a pivoted arm with a holder for a guide roller.

The exchanging apparatus shown in FIGS. 4 to 6 differs from that shown in FIGS. 1 to 3 in that different means 9 are provided for driving the two pivoted arms 3 and 4. In accordance with FIGS. 4 to 6 said arm-driving means 9 comprise power screws 19, which are non-rotatably mounted on the handling head 1 and pivotally movable relative to the latter. The pivoted axis for each screw 19 is defined by a transverse pivot 20, which is parallel to the pivot for the pivoted arms 3 and 4. A nut is threaded on said screw 19 and can be rotated about said screw by an electric motor 22 via a worm gear train 23 and a spur gear train 24. That electric motor 22, the gear trains 23 and 24 and the nut threaded on the screw 19 constitute a drive unit, which includes mounting means pivoted to the arm 3 or 4 by a pivot 21, which is parallel to the arm 3 or 4 by a pivot 21, which is parallel to and spaced from the pivot 2, so that said unit will perform a pivotal movement in unison with the screw 19 about the axis defined by the pivots 20 and 21. As the nut threaded on the screw 19 is driven, said nut travels along the screw 19 so that the associated pivoted arm 3 or 4, will be pivotally moved about the pivot 2 because the nut is pivotally movable about the pivot 21 relative to that pivoted arm 3 or 4.

As is apparent from FIGS. 4 and 5, the holders 5 carried by the pivoted arms 3 and 4 are constituted by receptacles 25, which are pivoted to the pivoted arms 3 and 4 on pivots 26 and are resiliently supported on the pivoted arms. For that purpose each pivoted arm 3 or 4 has an extension 27, which extends radially with respect to the pivot 26 of the receptacle 25 and which is gripped between two rubber springs 28. Said rubber springs 28 are held in a housing 29, which is rigidly connected to the cheeks of the receptacle 25, as is shown in FIG. 5. Because the receptacles are resiliently yieldable, any desired guide roller 6 can be removed from the array of such rollers even if the rollers are very closely spaced apart because the guide roller held in the receptacle 25 can yield to some extent. The movement of the holder 5 into engagement with a desired guide roller will not be obstructed by closely spaced apart rollers because the provision of the retaining magnets 7 eliminates the need for an embracing of the guide rollers by the holders around more than 180°.

To ensure that the guide rollers 6 will be reliably held in the holders 5, the retaining magnets 7 must be in snug surface engagement with the guide rollers. For this purpose the retaining magnets 7 associated with each receptacle 25 are carried by a magnet carrier 30, which is pivoted to the cheeks of the receptacle 25 by a pivot 31. The pivotal movement of the magnet carriers 30 is limited by stops, which are formed by a longitudinal slot 33, in which a pin 32 is guided. Because the magnet carrier 30 carries the solenoid 34 for exciting the retaining magnets 7, the magnet carrier 30 constitutes part of the iron core which together with the guide roller 6 constitutes a magnetic circuit. As the retaining magnets 7 are capable of a limited pivotal movement, said retaining magnets will be self-adjusting so that they will reliably engage the guide rollers 6.

I claim:

1. In apparatus for exchanging a billet-guiding roller for another in a plant for continuous casting, which apparatus comprises a handling head, two pivoted arms, each of which is pivoted to said handling head on a pivotal axis and carries a holder for holding one of said billet-guiding rollers so that its axis is parallel to said pivotal axis, said arms having two inner ends, which are adjacent to each other, and two outer ends which are remote from each other, and arm-driving means carried by said handling head and operable to impart to each of said arms a pivotal movement about said pivotal axis, the improvement residing in that said arms are pivoted to said handling head at said inner ends, said holders are mounted on said arms at said outer ends, and each of said holders comprises a receptacle for receiving one of said billet-guiding rollers and magnet means for releasably retaining a billet-guiding roller in said receptacle.

2. The improvement set forth in claim 1, wherein said magnets are switch-controlled.

3. The improvement set forth in claim 1, wherein both said pivoted arms are pivoted to said handling head on the same pivotal axis.

4. The improvement set forth in claim 3, wherein said arm-driving means comprise two cam slot members, each of which is non-rotatably connected to one of said pivoted arms and is formed with a cam slot having an extent in the direction of said pivotal axis and an angular extent about said pivotal axis, a slider, which is movable in engagement with both said cam slot members in said cam slots, and guiding means extending along said pivotal axis and adapted to guide said slider, along said pivotal axis, whereby a movement of said slider means along said pivotal axes in engagement with one of said cam slot members in the associated cam slot will result in an angular movement of said cam slot member about the pivotal axis of the associated arm.

5. The improvement set forth in claim 4, wherein said pivoted arms are pivotally movable about said pivotal axis independently of each other.

6. The improvement set forth in claim 4, wherein said cam slot members and said cam slots are respectively spaced along said guiding means.

7. The improvement set forth in claim 4, wherein each of said pivotal arms is pivotally movable independently of the other about said pivotal axis between extended and retracted positions relative to said mounting head, said cam slot members are aligned in the direction of said pivotal axis and have inner ends adjacent to each other, said cam slots have open ends at said inner ends of said cam slot members, said open ends of said cam slots register in the direction of said pivotal axis when both said pivoted arms are in said retracted position, and said slider is movable from one of said cam slots into the other when said pivoted arms are in said retracted position.

8. The improvement set forth in claim 4, wherein said slider is movable to a position in which it extends in both said cam slots to prevent a pivotal movement of said pivoted arms.

9. The improvement set forth in claim 4, wherein each of said cam slot members consists of at least part of a cylinder, which is coaxial to said pivotal axis.

10. The improvement set forth in claim 9, wherein each of said cam slot members consists of a cylinder.

11. The improvement set forth in claim 9, wherein each of said cam slot members consists of a segment of a cylinder.

12. The improvement set forth in claim 4, wherein said arm driving means comprise a power screw drive for moving said slider along said guiding means.

13. The improvement set forth in claim 1, wherein each of said holders comprises a magnet carrier, which is pivoted to said receptacle, and stop means limiting the pivotal movement of said magnet carrier, and said magnet means of each of said holders are carried by said magnet carrier.

14. The improvement set forth in claim 1, wherein each of said receptacles is pivoted to the associated pivoted arm on a pivotal axis and is resiliently supported on said pivotal arm.

15. The improvement set forth in claim 14, wherein each of said pivoted arms has an extension, which extends radially from said pivotal axis of the associated receptacle, and each of said receptacles comprises two rubber springs gripping said extension.

16. The improvement set forth in claim 1, wherein said magnet means comprise electromagnet means and storage battery means for energizing said electromagnet means are mounted on said handling head.

17. The improvement set forth in claim 1, wherein said arm-driving means comprise two cam slot members, each of which is non-rotatably connected to one of said pivoted arms and is formed with a cam slot having an extent in the direction of the pivotal axis of the associated arm and an angular extent around said pivotal axis, slider means which are movable in engagement with both said cam slot members in said cam slots, and guiding means extending along said pivotal axes and adapted to guide said slider means whereby a movement of said slider means along said pivotal axes in engagement with one of said cam slot members in the associated cam slot will result in an angular movement of said cam slot member about the pivotal axis of the associated arm.

18. The improvement set forth in claim 17, wherein each of said pivoted arms is pivotally movable independently of the other between retracted and extended positions relative to said handling head.

19. The improvement set forth in claim 17, wherein each of said cam slot members consists of at least part of a cylinder which is coaxial to the pivotal axis of the associated pivoted arm.

20. The improvement set forth in claim 19, wherein each of said cam slot members consists of a cylinder.

21. The improvement set forth in claim 19, wherein each of said cam slot members consists of a segment of a cylinder.

22. The improvement set forth in claim 17, wherein said arm-driving means comprise a power screw drive for moving said slider means along said guiding means,

23. The improvement set forth in claim 1, wherein said arm-driving means comprise for at least one of said arms a power screw drive comprising a screw, which is pivoted to said handling head on a pivotal axis which is parallel to and spaced from said pivotal axis of said pivoted arm, mounting means which are pivoted to said pivotal arm on a pivotal axis which is parallel to and spaced from the pivotal axis of said pivoted arm, a nut, which is threaded on said screw and mounted in said nut-mounting means for rotation about said screw, a worm gear train for rotating said nut about said screw and an electric motor for driving said worm gear train.

24. The improvement set forth in claim 23, wherein said electric motor and said worm gear train are mounted on said mounting means.

25. The improvement set forth in claim 23, wherein said arm-driving means comprise one of said power screw drives for each of said pivoted arms.

* * * * *